United States Patent [19]

Esquilat

[11] 4,058,913

[45] Nov. 22, 1977

[54] LIGHTWEIGHT TRAIL GROOMER

[75] Inventor: Georges Esquilat, Valcourt, Canada

[73] Assignee: Bombardier Limited, Canada

[21] Appl. No.: 671,036

[22] Filed: Mar. 29, 1976

[30] Foreign Application Priority Data

Jan. 2, 1976 Canada ..... 242919

[51] Int. Cl.[2] ..... E01H 5/06; A01B 15/10

[52] U.S. Cl. ..... 37/50; 172/738; 172/753; 172/387; 172/780; 172/764; 280/26

[58] Field of Search ..... 37/46, 10, 123, 50; 280/12 R, 12 F, 12 M, 24, 26, 28, 12 K, 12 KL, 12 L, 12 A, 12 C, 12 E, 15, 17, 27, 7.12, 7.14, 8–11; 172/738, 753, 387, 392, 393, 360, 188, 764, 727, 780

[56] References Cited

U.S. PATENT DOCUMENTS

| | | | |
|---|---|---|---|
| 379,394 | 3/1888 | Hennessy | 280/26 |
| 406,028 | 7/1889 | Cresap | 280/26 |
| 542,252 | 7/1895 | Gorder | 280/15 |
| 1,990,672 | 2/1935 | Schwuelle et al. | 172/387 |
| 2,222,386 | 11/1940 | Welch | 280/15 X |
| 2,722,067 | 11/1955 | Baron | 172/46 X |
| 2,786,283 | 3/1957 | Bradley | 37/10 |
| 3,030,123 | 4/1962 | Dworak | 280/26 |
| 3,739,859 | 6/1973 | White | 172/393 X |
| 3,815,688 | 6/1974 | Brown | 172/789 |
| 3,872,931 | 3/1975 | Camp | 172/387 |

FOREIGN PATENT DOCUMENTS

| | | | |
|---|---|---|---|
| 1,530,892 | 8/1969 | Germany | 280/8 |
| 479,539 | 12/1926 | Germany | 172/387 |

*Primary Examiner*—E. H. Eickholt

*Attorney, Agent, or Firm*—Larson, Taylor and Hinds

[57] ABSTRACT

A light weight trail groomer is supported at its rear end on each side by a pair of longitudinally aligned skis connected to respective arms of a bracket pivotally mounted on a main frame element. The frame structure is arranged for connection at its forward end to a towing vehicle and includes a scraper blade structure the height of which can be adjusted by independent adjuster means connected between an auxiliary frame structure and each one of the main frame elements.

9 Claims, 5 Drawing Figures

LIGHTWEIGHT TRAIL GROOMER

FIELD OF THE INVENTION

This invention relates to improvements in snow surface conditioning vehicles, and in particular to a new or improved groomer.

DESCRIPTION OF THE PRIOR ART

The sport of snowmobiling is today an extremely popular winter recreational activity which is engaged in by many thousands of people. A snowmobile is an extremely versatile vehicle which can travel over almost any terain in a snow condition ranging from deep powder to the solid ice found on lakes and rivers. However, one extremely popular form of the sport is trail snowmobiling, and in various parts of the country, local snowmobile clubs maintain very extensive networks of trails having a range of very many miles. The use of such trails offers the snowmobiler many advanatages including the opportunity of safe travel on a challenging course which is, at the same time, free of hazards as fence wires, thin river ice, and the like, and enables, the snowmobile to range over great distances without becoming involved with normal road traffic and without trespassing on anyones property. Because of their popularity, the snow conditions on such trails becomes packed down soon after any fresh snowfall. This initially provides very good riding conditions, however, after the passage of a hundred or so snowmobiles, certain parts of any snowmobile trail will eventually develop patches of ice, and stretches of moguls, i.e. short, sharp udulations, which make for riding conditions which are somewhat less than ideal. Most well-organized snowmobile clubs thus take steps to maintain their trails in good condition, and there are commerically available several types of snow conditioning vehicles, known as trail groomers, for this purpose. Such trail groomers are towed along the snowmobile trail and include scraper blades and other structure for breaking up ice and leveling moguls. Existing snow groomers are generally of very heavy and expensive construction, and cannot be towed by a conventional snowmobile, but rather require the use of a heavy industrial snow vehicle as a tractor.

SUMMARY OF THE INVENTION

The present invention provides a trail groomer comprising an elongate generally horizontal frame, means at a forward end of the frame for attachment to a towing vehicle, a transverse scraper blade positioned beneath the frame at an intermediate location in the length thereof, said frame having a rear end supported on ski means for sliding engagement with a snow surface, said ski means comprising a pair of laterally spaced brackets each of which has an intermediate portion pivoted on a common transverse axis at the rear of the frame and each having longitudinally spaced front and rear arms extending generally downwardly with respect to the frame, each arm being connected to a ski that the skis are positioned in pairs longitudinally aligned at opposite sides of the frame.

Conventional trail groomers are usually of very great length having a frame hitched at its forward end to the towing vechicle and supported on skis at it rear end with a scraper blade mounted approximately midway along the frame. The great length is necessary to reduce the effect on the vertical position of the scraper blade, of the tractor or the rear skis passing over moguls. Where the frame is too short, the scraper blade would be given an excessive vertical displacement, thus reducing its ability to level moguls. The mounting of the skis in the pivotal brackets of the trail groomer of the present invention, enables the skis to pass over a mogul without producing any excessive vertical displacement of the trail groomer frame, and accordingly the skis can be mounted closer to the scraper blade enabling the use of a much shorter frame, and consequently providing a trail groomer of reduced weight.

Means may be provided for adjustment of the vertical position of the scraper blade, and such means preferably comprise mounting a scraper blade on an auxiliary frame structure pivoted on a transverse axis on the main frame structure, the forward end of the auxiliary frame structure being attached to the towing vehicle, and adjustable connector means being positioned between the forward ends of the main frame structure and auxiliary frame structure to adjust the angular relationship therebetween.

A preferred embodiment or trail groomer is made of sufficiently light weight construction as to be capable of being towed by a conventional snowmobile, rather requiring a heavy duty industrial vehicle.

BRIEF DESCRIPTION OF THE DRAWINGS

A preferred embodiment of the invention will now be described, by way of example only, with reference to the accompanying drawings, in which.

DESCRIPTION OF THE PREFERRED EMBODIMENT

Figure 1:
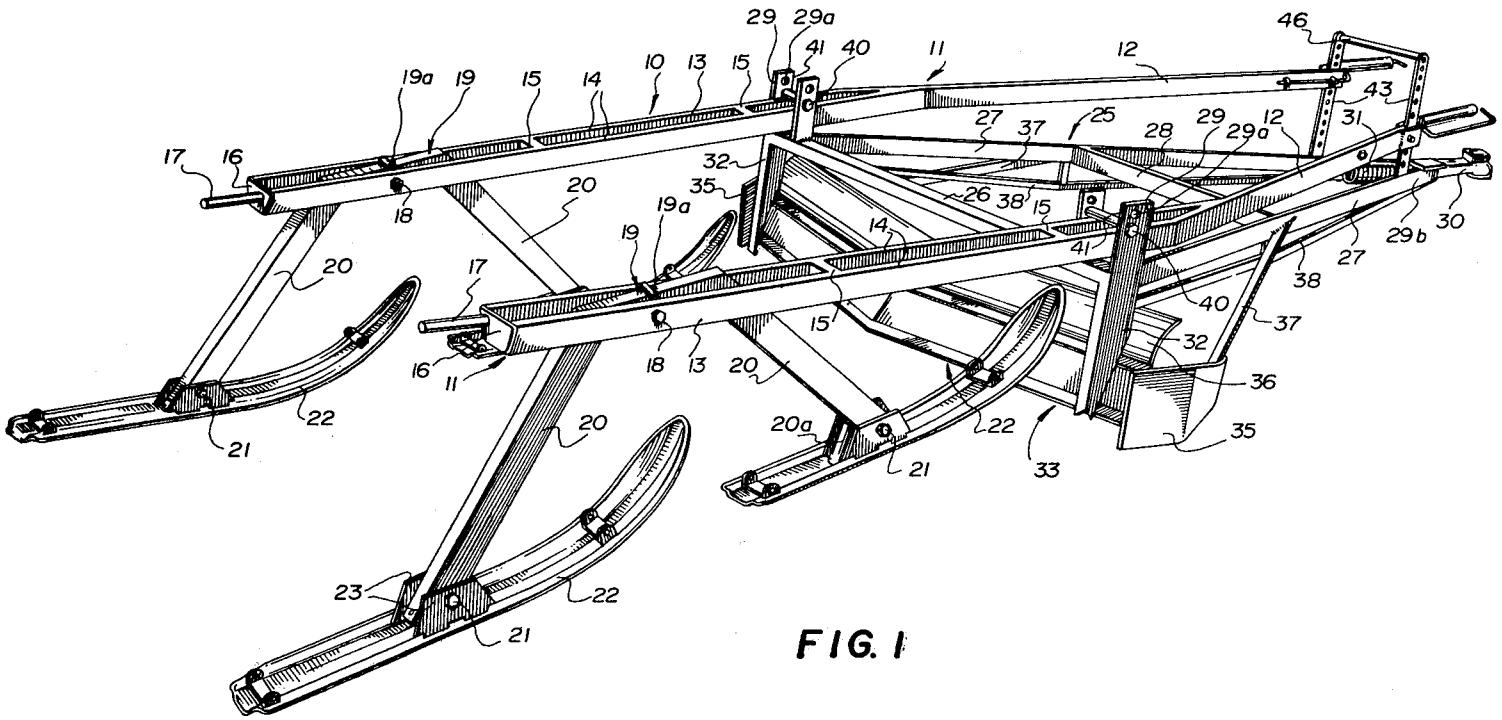
FIG. 1 is a perspective view of a snowmobile trail groomer in accordance with the present invention.

As shown in the drawings, the trail groomer comprises a generally horizontal frame having a main frame structure generally indicated at 10 formed by two longitudinally extending frame elements 11 having convergent front portions 12 and parallel rear portions 13. The rear portions 13 are of open beam construction, comprising two longitudinal vertical walls 14 separated by short transverse walls 15, and joined at their rear ends by plates 16 carrying rearwardly projecting handles 17.

Near its rear end, each of the frame elements 11 carries a bolt or pin 18 extending transversely between the walls 14, and providing a pivotal mounting for a bracket 19 of inverted V-shape having two, downwardly divergent arms 20. The lower end of each arm has a pivotal attachment on a pin 21 carried on the upper surface of a ski 22 between a pair of support plates 23. To provide adjustment in this pivotal mounting each bracket 19 carries on its upper side a bushing 19a welded thereto and providing an alternative means of connection of the bracket 19 to the bolt or pin 18.

Figure 2:
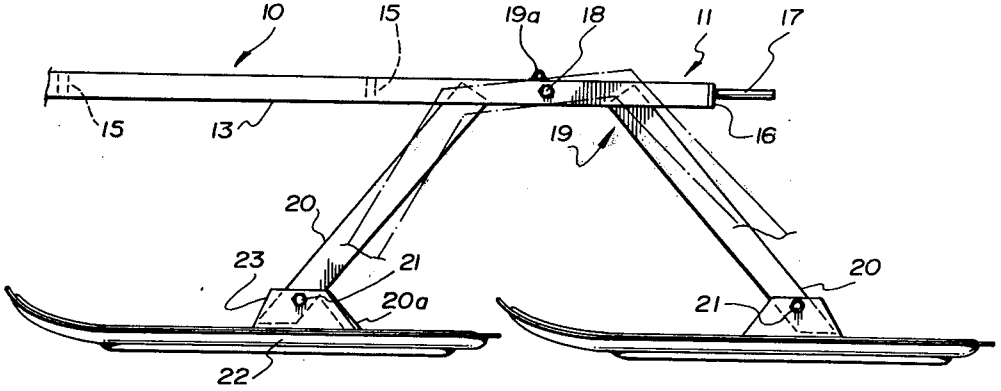
FIG. 2 is a side elevation of the rear portion of the trail groomer.

As will be evident, each bracket 19 is free to pivot in a vertical plane upon its mounting pin 18 through an angular range limited in one direction through abutment on the rear bracket arm 20 with the plate 16, and in the opposite direction through abutment of the forward arm with the rearmost of the two transverse walls 15 in the corresponding frame element. Similarly, each ski 22 can pivot in a vertical plane about the pin 21 at the lower end of each bracket arm 20 rearward pivotal movement of the front skis from the horizontal position being prevented by a tubular stopper rod 20a (FIGS. 1 and 2) welded at an angle to the rear side of the front arm 20.

At the forward end of trail groomer is an auxiliary frame structure 25 of generally triangular form having a rear transverse member 26 and two forwardly convergent lateral members 27 interconnected by a transverse brace 28, and meeting at their front ends in a bracket 29L. The bracket 29L mounts a towing hitch fixture 30 which includes a resilient damping means of conventional form, generally illustrated at 31. Each outboard end of the lateral member 27 of the auxiliary frame structure has a dependent leg 32, between which is supported a horizontal scraper blade structure generally illustrated at 33. The scraper blade structure is of conventional design incorporating replaceable toothed sections (not shown) arranged in a shallow V-formation in plan view, having forwardly inclined mold plates 35 at their outboard ends, and a forwardly curved deflector plate 36 mounted along its upper edge, the mold plates being strengthened by suitable braces 37 connected to the lateral member 27 of the auxiliary frame structure. The scraper blade toothed sections have teeth along their upper and lower edges and can be inverted when the teeth on one edge become worn. Further longitudinal braces 38 extend from the legs 32 at the upper edge of the deflector plate 36 forwardly beneath the corresponding lateral members to converge therewith in the region of the bracket 29L. The V-formation of the blades directs snow towards the centre of the trail where irregularities are usually more pronounced.

Directly above each of the legs 32, a U-shaped bracket 29 extends upwardly from the transverse member 26 and supports the end of a transversely arranged pin 40 which passes through a bearing sleeve 41, secured to the frame element 11, as by welding. The two bearing sleeves 41 are axially aligned, and together provide a pivotal mounting for the auxiliary frame structure 25 and the scraper blade 33. Each of the brackets 29 has a position of attachment to the pin 40 deferred by a pair of holes 29a in the bracket limbs.

Figure 5:
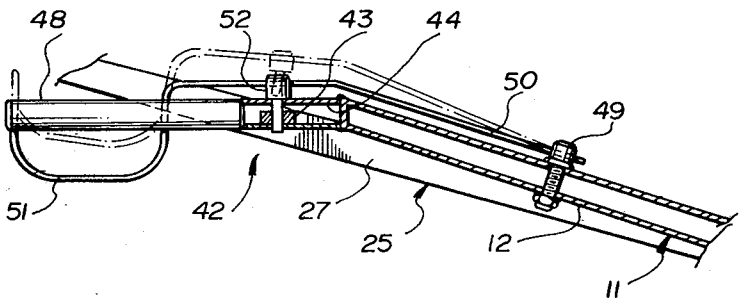
FIG. 5 is a sectional view taken on the line V—V in FIG. 4 .

Adjusting means is provided, generally indicated at 42, for selectively varying the angular relationship between the main frame structure 10 and the auxiliary frame structure 25. As shown more clearly in FIGS. 3, 4 and 5, the adjusting means comprises a strut 43 extending generally vertically upwards from near the front of each lateral member 27 of the auxiliary frame structure, and projected through a large guideway 44 formed at the front end of each of the frame elements 11 of the main frame structure. Each strut 43 is provided with a series of elongated apertures 45 closely spaced along the length thereof, the upper ends of the struts being interconnected by a cross piece 46. On each side of the guideways 44, the front ends of the frame elements 11 are formed with transversely aligned apertures 47 and a cylindrical handle 48 is secured to the front end of each guide element 11 and extends forwardly therefrom.

Near the front of each of the frame elements 11 is clamped an eye bolt 49 which secures one end of a spring wire 50 to the frame element 11. Each spring wire extends along the inboard face of its frame element 11, and is bent outwardly beyond the front end of the latter to form a handle loop 51 at its free end adjacent the handle 48 at the front of the corresponding frame element. Intermediate its ends, each spring wire 50 carries a detent in the form of a pin 52 the head of which is secured to the spring wire, and the shank of which extends in alignment with the apertures 47 in the frame elements 11. Thus, when the apertures 47 are in alignment with an aperture 45 in the strut 43, the resilient force of the spring wire urges it to the position shown in full line in FIG. 5 with the pin 52 extending through these aligned apertures. The handle loop 51 of the spring wire may be readily manipulated by a hand, which may at the same time grasp the handle 48 to withdraw the pin 52 to the retracted position shown in broken lines in FIG. 5.

From the foregoing description, it will be appreciated that the height of the scraper blade structure 33 in relation to the skis 22 can be varied selectively by manipulating the adjusting means 42 to vary the angular relationship between the main frame structure 11 and the auxiliary frame structure 25. Since it is the auxiliary frame structure which is attached to the towing vehicle, upwards movement of the front end of the main frame structure will raise the scraper blade, and downward movement will lower it. To effect adjustment, the operator grips in each hand one of the handles 48 and the associated handle loop of the spring wire 50, and manipulates the latter to to retract the pins 52. With the pins in the retracted position, the operator then raises or lowers the main frame structure 10 through the handles 48 to a desired extent, registering the apertures 47 with selected apertures in the struts 43 thereafter releasing the handle loops 51, so that the force of the spring wire returns the detent pins 52 to the engaged position wherein they extend through the alinged apertures 47 and 45 thus securing the main frame structure 10 in the desired position.

It will be noted that the path of movement of the apertures 47 is arcuate, whereas the struts 43 are straight. However the elongate form of the apertures 45 in the struts maintains alignment between these apertures and the apertures 47 throughout the range of adjustment.

Figure 3:
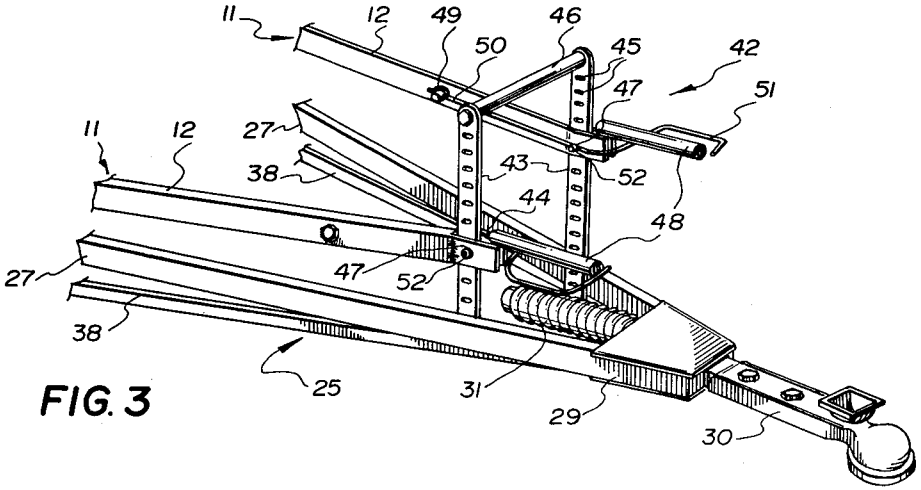
FIG. 3 is a fragmentary view of the forward end of the trail groomer.
Figure 4:
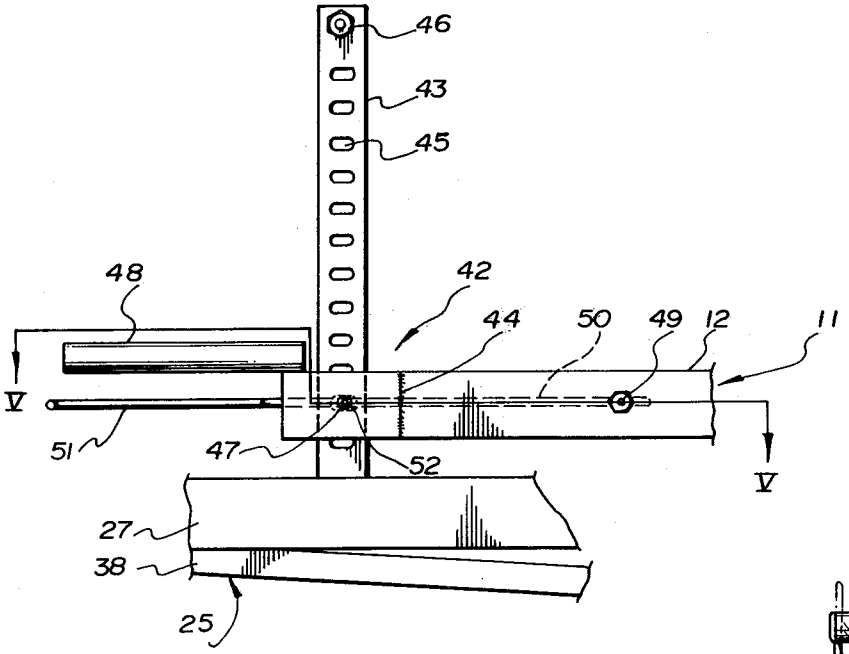
FIG. 4 is a fragmentary side elevation, to an enlarged scale, of part of the forward end of the trail groomer.

Normally it will be desired to maintain the scraper blade structure 33 horizontal in the transverse direction. However, it will be noted that there is no direct connection between the frame elements 11 of the main frame structure 10, and accordingly, as illustrated in FIG. 3, these can be moved to different positions of adjustment on the struts 43 thereby providing a desired degree of lateral inclination in the blade structure 33.

The above described trail groomer is of light weight construction, the structural members thereof being fabricated generally as hollow box beams, such that the groomer readily can be handled and lifted by means of the handles 17 and 48.

The skis 22 are removable and can, when desired, be replaced by a large rectangular compactor plate (not shown) which attaches to the lower ends of the bracket limbs 20. The compactor plate may be employed to achieve compaction of a loose snow surface and may be weighted to effect the degree of compaction required. Similarly the skis 22 may be replaced by trail marker skis (not shown) where it is desired to condition a trail for crosscountry skiing.

What I claim as my invention is:

1. A trail groomer comprising an elongate generally horizontal frame, means at a forward end of the frame for attachment to a towing vehicle, a transverse scraper blade positioned beneath the frame at an intermediate location in the length thereof, said frame having a rear end supported on ski means for sliding engagement with a snow surface, said ski means comprising a pair of laterally spaced brackets each of which has an intermediate portion pivoted on a common transverse axis at the rear of the frame and each having longitudinally spaced front and rear arms extending generally downwardly with respect to the frame, each arm being connected to a ski such that the skis are positioned in pairs longitudinally aligned at opposite sides of the frame, said frame including a main frame structure supporting said laterally spaced brackets, and an auxiliary frame structure pivoted on a second transverse axis on the main frame structure at said intermediate location and having dependent arm means supporting said scraper blade, said auxiliary frame structure extending forwardly from said location and having a forward portion which carries said attachment means, adjustable connector means linking said auxiliary frame structure to said main frame structure at a selectively variable angular relationship with respect to said second transverse axis whereby in use to provide means to vary the height of said scraper blade with respect to a snow surface upon which the trail groomer is to be towed.

2. A trail groomer according to claim 1 wherein said main frame structure extends forwardly of said second transverse axis to a forward portion overlying the forward portion of the auxiliary frame structure, said adjustable connector means comprising strut means extending from one of said forward portions in a generally upright direction and releasable clamping means on the other said forward portion engagable with said strut means at longitudinally spaced locations thereon.

3. A trail groomer according to claim 2 wherein said strut means is mounted on the forward portion of the auxilary frame structure and extends upwardly thereon having a series of closely spaced apertures at said longitudinally spaced locations, said releasable clamping means comprising a guideway in said forward portion of said main frame structure with respect to which guideway said strut means is longitudinally movable, and a manually operable detent selectively engageable with said apertures to retain said strut at a predetermined longitudinal position with respect to said guideway.

4. A trail groomer according to claim 3 including handle means at the forward portion of said main frame structure affording a handgrip for use in making vertical adjustments in the height thereof, said detent being resiliently urged towards engagement with said strut means and being connected to an actuator positioned adjacent said handle means for manual engagement by an operator simultaneously therewith.

5. A trail groomer according to claim 1, wherein said main frame structure comprises two laterally spaced independent frame elements each mounting one of said ski-supporting brackets, said adjustable connector means linking each said frame element to said auxiliary frame element independently of the other, whereby said connector means is adjustable to provide a lateral inclination in the adjusted position of the scraper blade.

6. A trail groomer comprising an elongate generally horizontal frame, means at a forward end of the frame for attachment to a towing vehicle, a transverse scraper blade positioned beneath the frame at an intermediate location in the length thereof, said frame having a rear end supported on ski means for sliding engagement with a snow surface, and including a main structure carrying said ski means, and an auxiliary frame structure pivoted on a transverse axis on the main frame structure at said intermediate location and having dependent arm means supporting said scraper blade, said auxiliary frame structure extending forwardly from said location and having a forward portion which carries said attachment means, adjustable connector means linking said auxiliary frame structure to said main frame structure at a selectively variable angular relationship with respect to said transverse axis whereby in use to provide means to vary the height of said scraper blade with respect to a snow surface upon which the trail groomer is to be towed.

7. A trail groomer according to claim 6 wherein said main frame structure extends forwardly of said transverse axis to a forward portion overlying the forward portion of the auxiliary frame structure, said adjustable connector means comprising strut means extending from one of said forward portions in a generally upright direction and releasable clamping means on the other said forward portion engagable with said strut means at longitudinally spaced locations thereon.

8. A trail groomer according to claim 7 wherein said strut means is mounted on the forward portion of the auxiliary frame structure and extends upwardly thereon having a series of closely spaced apertures at said longitudinally spaced locations, said releasable clamping means comprising a guideway in said forward portion of said main frame structure with respect to which guideway said strut means is longitudinally movable, and a manually operable detent selectively engageable with said apertures to retain said strut at a predetermined longitudinal position with respect to said guideway.

9. A trail groomer according to claim 8 including handle means at the forward portion of said main frame structure affording a handgrip for use in making vertical adjustments in the height thereof, said detent being resiliently urged towards engagement with said strut means and being connected to an actuator positioned adjacent said handle means for manual engagement by an operator simultaneously therewith.

* * * * *